US007673957B2

(12) United States Patent
Anderson et al.

(10) Patent No.: US 7,673,957 B2
(45) Date of Patent: Mar. 9, 2010

(54) METHOD FOR DETERMINING AN OPTIMAL NON-NUCLEATING HEATER PULSE FOR USE WITH AN INK JET PRINTHEAD

(75) Inventors: Timothy Lee Anderson, Lexington, KY (US); Patrick Laurence Kroger, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 857 days.

(21) Appl. No.: 11/122,191

(22) Filed: May 4, 2005

(65) Prior Publication Data

US 2006/0250465 A1 Nov. 9, 2006

(51) Int. Cl.
*B41J 29/393* (2006.01)
*B41J 29/38* (2006.01)
*B41J 2/01* (2006.01)

(52) U.S. Cl. ..... 347/19; 347/14; 347/102

(58) Field of Classification Search ..... 347/9, 347/12, 14, 19, 60, 16
See application file for complete search history.

(56) References Cited

U.S. PATENT DOCUMENTS 5,838,340 A 11/1998 Shimoda
5,923,344 A 7/1999 Norum et al.
6,036,298 A 3/2000 Walker
6,154,230 A 11/2000 Holstun et al.
6,234,602 B1 5/2001 Soto et al.
6,244,682 B1 * 6/2001 Walker et al. ..... 347/19
6,283,650 B1 * 9/2001 Yamada et al. ..... 400/120.14
6,322,192 B1 11/2001 Walker
6,325,482 B1 12/2001 Hayasaki et al.
6,345,876 B1 2/2002 Tanaka et al.
6,367,903 B1 4/2002 Gast et al.
6,412,903 B1 7/2002 Lee et al.
6,467,864 B1 10/2002 Cornell
6,669,324 B1 12/2003 King et al.
6,789,871 B2 9/2004 Edelen et al.
2002/0047873 A1 * 4/2002 Imanaka et al. ..... 347/19
2002/0158936 A1 * 10/2002 Otsuka et al. ..... 347/19
2005/0156979 A1 * 7/2005 Chang ..... 347/19

* cited by examiner

*Primary Examiner*—Stephen D Meier
*Assistant Examiner*—Kar Yip

(57) ABSTRACT

A method for use with an ink jet printhead having a plurality of nozzles, each of the plurality of nozzles having associated therewith a respective heating element, includes printing with the plurality of nozzles a test pattern while varying an energy of a respective heater pulse used to energize each respective heating element at each of a plurality of printhead carrier positions; scanning the test pattern with a reflectance sensor to generate reflectance data associated with the energy of the respective heater pulse used to energize each respective heating element at each of the plurality of printhead carrier positions; and determining an optimal non-nucleating heater pulse for use with the ink jet printhead based on the reflectance data.

19 Claims, 8 Drawing Sheets

METHOD FOR DETERMINING AN OPTIMAL NON-NUCLEATING HEATER PULSE FOR USE WITH AN INK JET PRINTHEAD

BACKGROUND OF THE INVENTION

1. Field of the Invention

The present invention relates to an ink jetting apparatus, and, more particularly, to a method for determining an optimal non-nucleating heater pulse for use with an ink jet printhead.

2. Description of the Related Art

An ink jetting apparatus, such as an ink jet printer, forms an image on a sheet of print media by ejecting ink from at least one ink jet printhead to place ink dots on the sheet of print media. Such an ink jet printer typically includes a reciprocating printhead carrier that transports one or more ink jet printheads across the sheet of print media along a bi-directional scanning path defining a print zone of the printer. The bi-directional scanning path is oriented parallel to a main scan direction, also commonly referred to as the horizontal direction. During printing on each scan of the printhead carrier, the sheet of print media is held stationary. An indexing mechanism is used to incrementally advance the sheet of print media in a sheet feed direction, also commonly referred to as a sub-scan direction, through the print zone between scans in the main scan direction, or after all data intended to be printed on the sheet of print media at a particular stationary position has been completed.

Ink jet printhead nucleating pulses, also known as fire pulses, are generated having energy, based on electrical power and pulse duration, sufficient to eject an ink drop from a nozzle of the ink jet printhead. Also, it is common to use non-nucleating pulses to heat the ink jet printhead to the correct printhead operating temperature prior to printing. Currently, non-nucleating pulses are generated by sending fixed pulse width pre-fire and fire pulses that are shorter in duration than a typical fire pulse, so as to prevent nucleation. These short pulses will add heat into the printhead without ejecting ink. Various algorithms are used to heat the ink jet printhead using these fixed pulse widths. Typically, it is desired to use the longest pulse possible to heat the ink jet printhead in the shortest amount of time possible. However, variations in ink jet printheads, even ink jet printheads of the same generally type, e.g., model number, forces these non-nucleating pulse widths to be shorter than optimal to prevent an accidental nucleating, i.e., fire, pulse from being generated.

What is needed in the art is a method for determining an optimal non-nucleating heater pulse for use with an ink jet printhead.

SUMMARY OF THE INVENTION

The invention, in one form thereof, is directed to a method for use with an ink jet printhead having a plurality of nozzles, each of the plurality of nozzles having associated therewith a respective heating element. The method includes printing with the plurality of nozzles a test pattern while varying an energy of a respective heater pulse used to energize each respective heating element at each of a plurality of printhead carrier positions; scanning the test pattern with a reflectance sensor to generate reflectance data associated with the energy of the respective heater pulse used to energize each respective heating element at each of the plurality of printhead carrier positions; and determining an optimal non-nucleating heater pulse for use with the ink jet printhead based on the reflectance data.

The invention, in another form thereof, is directed to an ink jetting apparatus, including a printhead carrier, and at least one ink jet printhead installed in the printhead carrier. The ink jet printhead has a plurality of nozzles, each of the plurality of nozzles having associated therewith a respective heating element. A reflectance sensor is mounted to the printhead carrier. A controller executes program instructions for performing the steps of printing with the plurality of nozzles a test pattern while varying an energy of a respective heater pulse used to energize each respective heating element at each of a plurality of printhead carrier positions; scanning the test pattern with a reflectance sensor to generate reflectance data associated with the energy of a respective heater pulse used to energize each respective heating element at each of the plurality of printhead carrier positions; and determining an optimal non-nucleating heater pulse for use with the ink jet printhead based on the reflectance data.

The invention, in still another form thereof, is directed to an ink jet printhead, including a nozzle plate having a plurality of nozzles, and a memory that stores a value associated with an optimal non-nucleating heater pulse generated based on reflectance data determined from a test pattern generated by the ink jet printhead.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
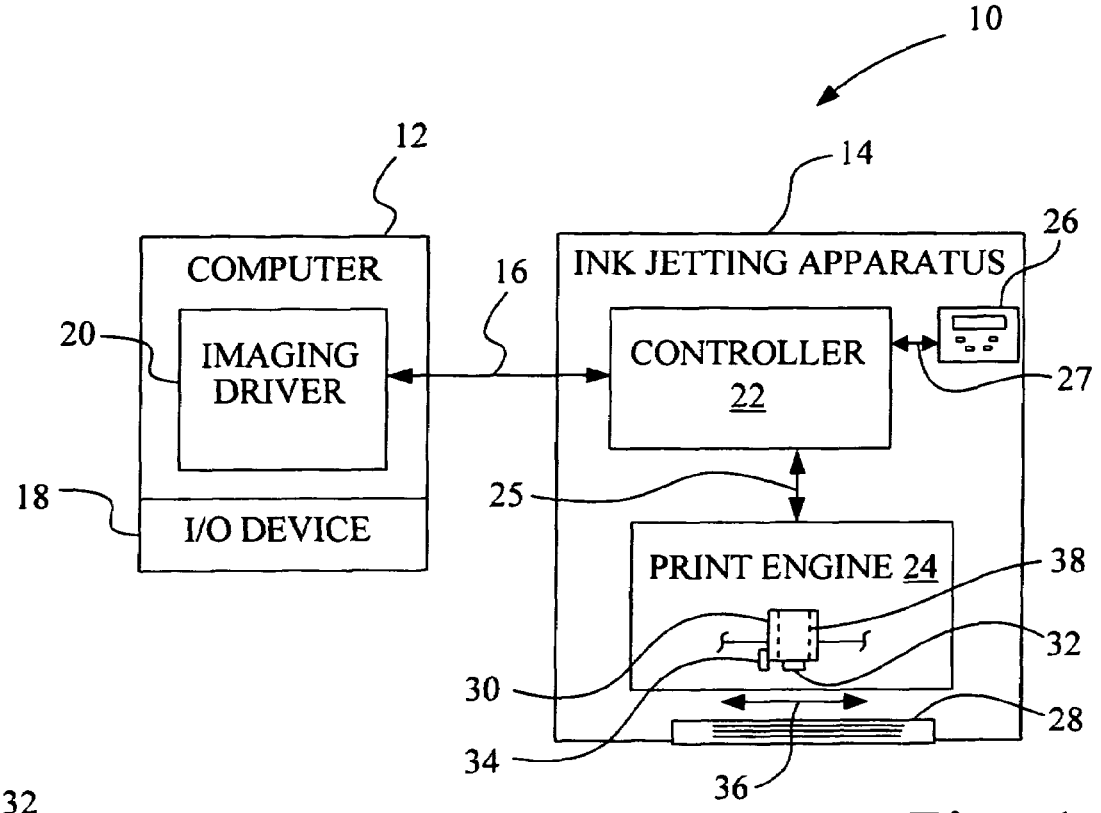
FIG. 1 is a diagrammatic depiction of a system embodying the present invention.

Referring to FIG. 1, there is shown a diagrammatic depiction of an imaging system 10 embodying the present invention. Imaging system 10 may include a computer 12 and an ink jetting apparatus 14. Ink jetting apparatus 14 communicates with computer 12 via a communications link 16. Communications link 16 may be established by a direct cable connection, wireless connection or by a network connection such as for example an Ethernet local area network (LAN).

Alternatively, ink jetting apparatus 14 may be a standalone unit that is not communicatively linked to a host, such as computer 12. For example, ink jetting apparatus 14 may take the form of an all-in-one, i.e., multifunction, machine that includes standalone copying and facsimile capabilities, in addition to optionally serving as a printer when attached to a host, such as computer 12.

Computer 12 may be, for example, a personal computer including an input/output (I/O) device 18, such as keyboard and display monitor. Computer 12 further includes a processor, input/output (I/O) interfaces, memory, such as RAM, ROM, NVRAM, and a mass data storage device, such as a hard drive, CD-ROM and/or DVD units. During operation, computer 12 includes in its memory a software program including program instructions that function as an imaging driver 20, e.g., printer driver software, for ink jetting apparatus 14.

In the example of FIG. 1, ink jetting apparatus 14 includes a controller 22, a print engine 24 and a user interface 26.

Imaging driver 20 of computer 12 is in communication with controller 22 of ink jetting apparatus 14 via communications link 16. Imaging driver 20 facilitates communication between ink jetting apparatus 14 and computer 12, and may provide formatted print data to ink jetting apparatus 14, and more particularly, to print engine 24. Alternatively, however, all or a portion of imaging driver 20 may be located in controller 22 of ink jetting apparatus 14. For example, where ink jetting apparatus 14 is a multifunction machine having standalone capabilities, controller 22 of ink jetting apparatus 14 may include an imaging driver configured to support a copying function, and/or a fax-print function, and may be further configured to support a printer function. In this embodiment, the imaging driver facilitates communication of formatted print data, as determined by a selected print mode, to print engine 24.

Controller 22 includes a processor unit and associated memory, and may be formed as an Application Specific Integrated Circuit (ASIC). Controller 22 communicates with print engine 24 via a communications link 25. Controller 22 communicates with user interface 26 via a communications link 27. Communications links 25 and 27 may be established, for example, by using standard electrical cabling or bus structures, or by wireless connection.

Print engine 24 may be, for example, an ink jet print engine configured for forming an image on a sheet of print media 28, such as a sheet of paper, transparency or fabric.

Print engine 24 may include, for example, a reciprocating printhead carrier 30, at least one ink jet printhead 32, and a reflectance sensor 34. Printhead carrier 30 transports ink jet printhead 32 and reflectance sensor 34 in a reciprocation manner in a bi-directional main scan direction 36 over an image surface of sheet of print media 28 during printing and/or sensing operations.

Printhead carrier 30 may be mechanically and electrically configured to mount, carry and facilitate one or more printhead cartridges 38, such as a monochrome printhead cartridge and/or one or more color printhead cartridges. Each printhead cartridge 38 may include, for example, an ink reservoir containing a supply of ink, to which at least one respective printhead 32 is attached. In order for print data from computer 12 to be properly printed by print engine 24, the rgb data generated by computer 12 is converted into data compatible with print engine 24 and printhead(s) 32.

In one system using cyan, magenta, yellow and black inks, printhead carrier 30 may carry four printheads, such as printhead 32, with each printhead carrying a nozzle array dedicated to a specific color of ink, e.g., cyan, magenta, yellow and black. As a further example, a single printhead, such as printhead 32, may include multiple ink jetting arrays, with each array associated with one color of a plurality of colors of ink, and printhead carrier 30 may be configured to carry multiple printheads.

Figure 2:
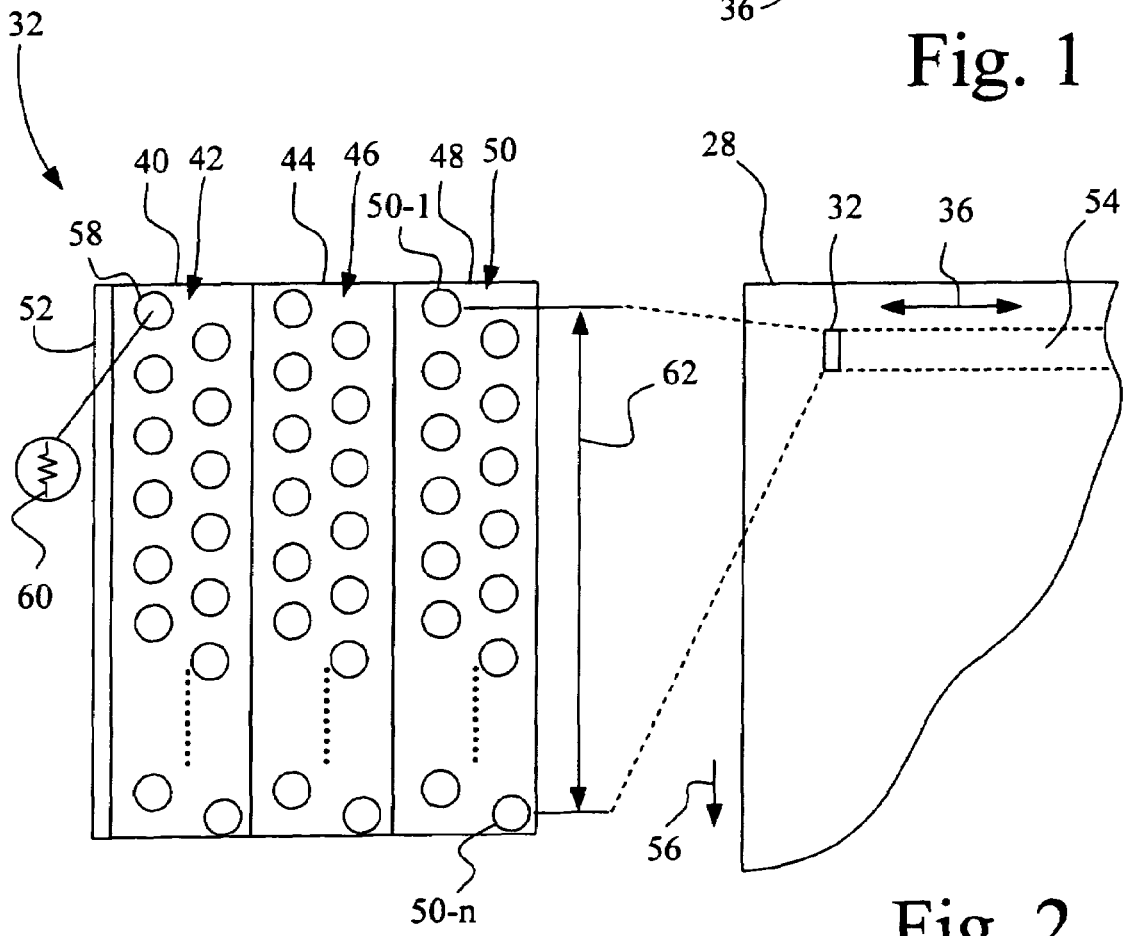
FIG. 2 is an exemplary depiction of the printhead of FIG. 1, with the printhead being projected over a sheet of print media.

FIG. 2 shows one exemplary configuration of printhead 32, which includes a cyan nozzle plate 40 including a nozzle array 42, a yellow nozzle plate 44 including a nozzle array 46, and a magenta nozzle plate 48 including a nozzle array 50, for respectively ejecting cyan (C) ink, yellow (Y) ink, and magenta (M) ink.

Printhead 32 may include a printhead memory 52 for storing information relating to printhead 32 and/or ink jetting apparatus 14. For example, memory 52 may be formed integral with printhead 32, or may be attached to printhead cartridge 38.

As further illustrated in FIG. 2, printhead carrier 30 is controlled by controller 22 to move printhead 32 in a reciprocating manner in main scan direction 36, with each left to right, or right to left movement of printhead carrier 30 along main scan direction 36 over the sheet of print media 28 being referred to herein as a pass. The area traced by printhead 32 over sheet of print media 28 for a given pass will be referred to herein as a swath, such as for example, swath 54 as shown in FIG. 2. The sheet of media 28 may be advanced between passes in a media feed direction 56.

In the exemplary nozzle configuration for ink jet printhead 32 shown in FIG. 2, each of nozzle arrays 42, 46 and 50 include a plurality of ink jetting nozzles 58, with each ink jetting nozzle 58 having at least one corresponding heating element 60. As between nozzle arrays of different printheads of the same type, or as from one nozzle array in comparison to another, the nozzle sizes of the plurality of ink jetting nozzles may vary from a nominal nozzle size, and heating element characteristics may vary, due to variations which occur during manufacture of the printhead silicon and nozzle plate, e.g., nozzle plates 40, 44, 48, respectively, that includes the respective nozzle array. For example, where nozzle plates 40, 44, 48 are formed from a polyimide or other plastic material, such variation in nozzle diameter may result from the technique used to form the nozzle openings in the nozzle plate, such as for example, through the use of laser ablation in forming the ink jetting nozzles 58 in the polyimide nozzle plate.

A swath height 62 of swath 54 corresponds to the distance between the uppermost and lowermost of the nozzles within an array of nozzles of printhead 32. For example, in nozzle array 50, nozzle 50-1 is the uppermost nozzle and nozzle 50-n is the lowermost nozzle. In the example of FIG. 2, the swath height 62 is the same for each of nozzle arrays 42, 46 and 50; however, this need not be the case, i.e., it is possible that the swath heights of nozzle arrays 42, 46 and 50 may be different, either by design or due to manufacturing tolerances.

Controller 22 may provide individual temperature control for each heating element 60, respectively, associated with ink jetting nozzles 58 of printhead 32. For example, each ink jetting nozzle 58 may be preheated to a respective predetermined temperature using a respective non-nucleating heater pulse, on a per nozzle basis. Ideally, each non-nucleating heater pulse is of duration that a vapor bubble is not formed in the liquid ink, and accordingly, no drop of ink is ejected from the corresponding ink jetting nozzle 58. In accordance with the present invention, an optimal non-nucleating heater pulse is determined for use with ink jet printhead 32.

Figure 3:
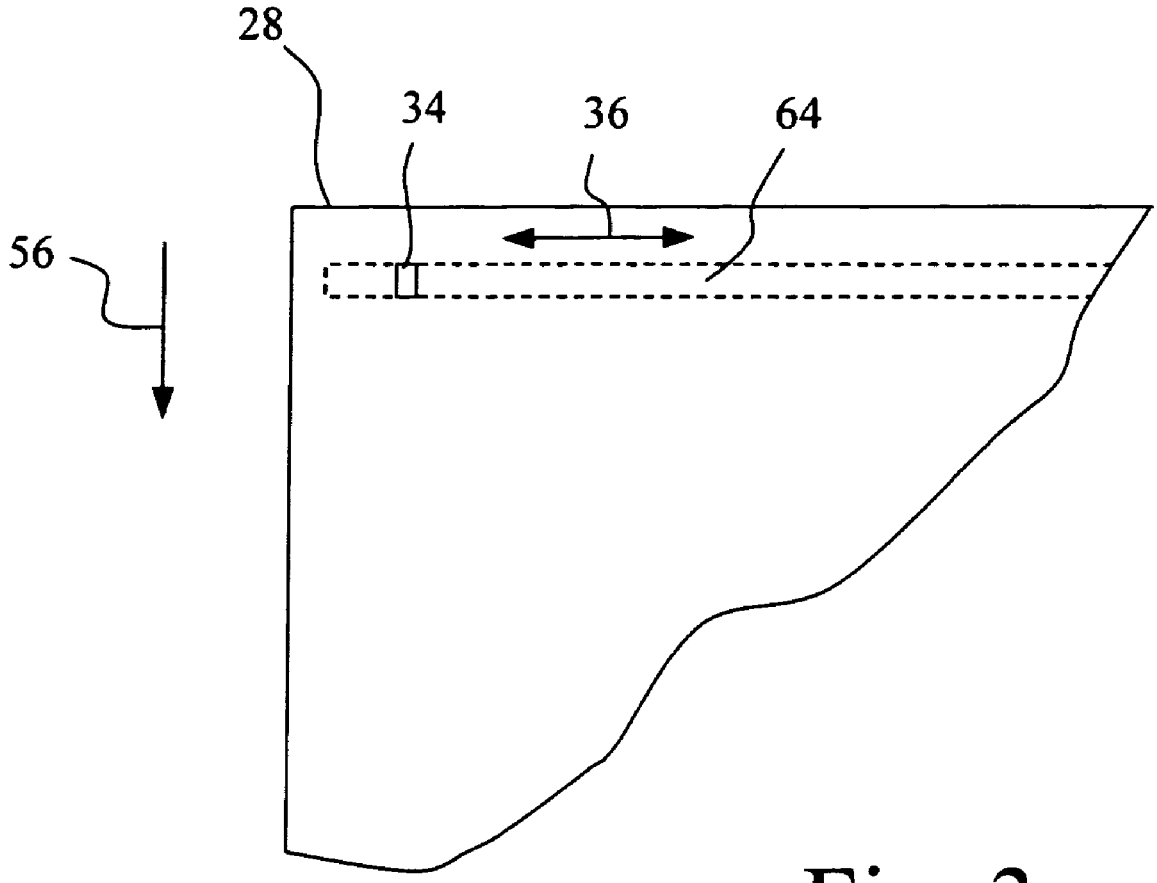
FIG. 3 is an exemplary depiction of the reflectance sensor of FIG. 1, with the reflectance sensor being projected over a sheet of print media.

As further illustrated in FIG. 3, printhead carrier 30 is controlled by controller 22 to move reflectance sensor 34 in a reciprocating manner in main scan direction 36. The area traced by reflectance sensor 34 over sheet of print media 28 will be referred to herein as a sense path, such as for example, sense path 64. The height of sense path 64 may be substantially less than the height 62 of swath 54.

Reflectance sensor 34 is configured to provide reflectance data to controller 22 via communications link 25. Reflectance sensor 34 may be, for example, a unitary optical sensor including at least one light source, such as a light emitting diode (LED), and at least one reflectance detector, such as a phototransistor. The reflectance detector is located on the same side of the sheet of print media 28 as the light source. The operation of such sensors is well known in the art, and thus, will be discussed herein to the extent necessary to relate the operation of reflectance sensor 34 to the operation of the present invention. For example, the LED of reflectance sensor 34 directs light at a predefined angle onto a surface to be read, such as the surface of the sheet of print media 28, and at least a portion of light reflected from the surface is received by the reflectance detector of reflectance sensor 34. The intensity of the reflected light received by the reflectance detector varies with the reflectance, i.e., reflectivity, of the surface. The light received by the reflectance detector of reflectance sensor 34 is converted to an electrical signal by the reflectance detector of reflectance sensor 34, and is supplied to controller 22 for further processing. The signal generated by the reflectance detector corresponds to the reflectance of the surface scanned by reflectance sensor 34. Thus, as used herein, the term "reflectance" refers to the intensity of the light reflected from the sheet of print media 28 scanned by reflectance sensor 34, which may be used in accordance with the present invention in determining an optimal non-nucleating heater pulse for use with ink jet printhead 32.

Alternatively, the function of reflectance sensor 34 may be performed by a separate scanner, such as for example, a scan bar in an all-in-one machine.

Figure 4:
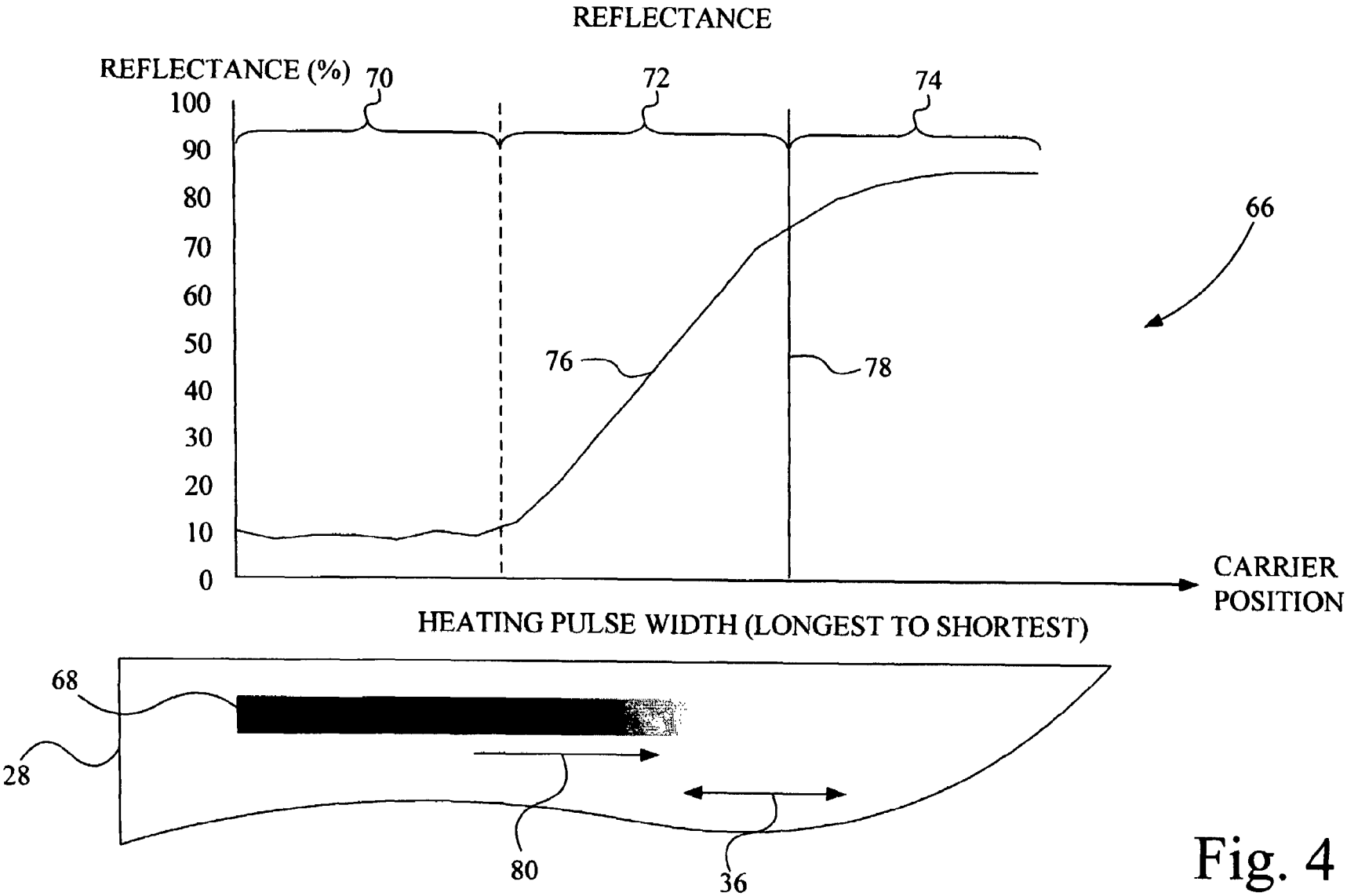
FIG. 4 is a graphical representation of reflectance data in relation to a generated test pattern.

FIG. 4 includes a graph 66 providing a graphical representation of reflectance data generated in relation to a test pattern 68 printed by an ink jet printhead, such as ink jet printhead 32, that corresponds, for example, to swath 54 (see FIG. 2) as scanned by reflectance sensor 34 along sense path 64 (see FIG. 3). For ease of discussion, graph 66 has been divided into three regions: region 70, region 72 and region 74. Region 70 corresponds to the portion of test pattern 68 where nucleation is ensured. Region 72 is a transition region, and corresponds to the portion of test pattern 68 where nucleation is intermittent. As shown in graph 66, the slope of the line 76 representing percent reflectance vs. carrier position is greatest in transition region 72. Region 74 corresponds to the portion of test pattern 68 where nucleation ends.

As shown in FIG. 4, dark areas of test pattern 68 correspond to a lower percent reflectance, whereas as test pattern 68 lightens, the percent reflectance increases. As shown in FIG. 4, an ideal heater pulse width for ensuring non-nucleation may be determined based on the slope of the line 76 representing percent reflectance after the transition region 72. With respect to FIG. 4, the ideal heater pulse width for ensuring non-nucleation is the heater pulse width associated with the percent reflectance at line 78.

Alternatively, test pattern 68 may be generated by using a plurality of adjacent blocks rather than a continuous block as shown in FIG. 4.

Figure 5:
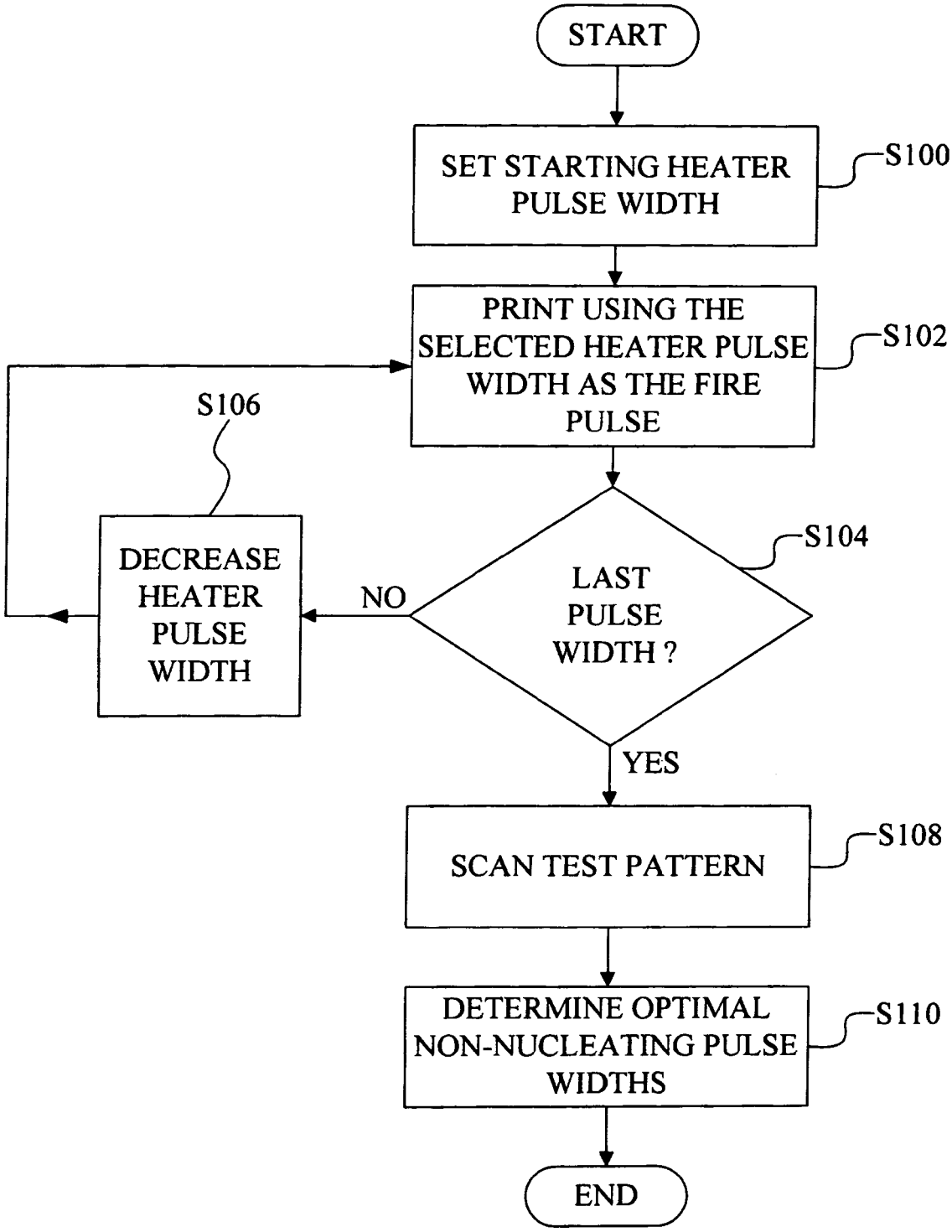
FIG. 5 is a general flowchart of a method for determining an optimal non-nucleating pulse for use with the printhead of FIG. 1, in accordance with the present invention.

FIG. 5 is a flowchart depicting a general method for determining an optimal non-nucleating pulse for use with a printhead, such as ink jet printhead 32 of FIG. 1, in accordance with the present invention.

At step S100, the starting, i.e., initial, heater pulse width is set having sufficient energy to ensure nucleation, e.g., ink drop ejection.

At step S102, printing is performed using the selected heater pulse width as the fire pulse, which is applied to the heating elements 60 of printhead 32. As will become evident below, step S102 will be repeated multiple times to form test pattern 68 of FIG. 4.

At step S104, it is determined whether the present pulse width was the last pulse width to be used in generating test pattern 68 of FIG. 4.

If the determination at step S104 is NO, then at step S106, the heater pulse energy, e.g., pulse width, is decreased, and the process returns to step S102 to continue printing test pattern 68.

As a result of steps, S100-S106, test pattern 68 is formed as a single block pattern printed on the sheet of print media 28, such as on a printhead alignment page, starting, for example, on the left side of the page by energizing each of the heating elements 60 of ink jet printhead 32 using nucleating pulses having sufficient energy to ensure nucleation, e.g., ink drop ejection, and then decreasing the energy of the pulses applied to heating elements 60 as printhead 32 is transported by printhead carrier 30 from left to right in direction 80 along main scan direction 36 until there is no more nucleation.

If the determination at step S104 is YES, then the test pattern generation process is completed, and the process proceeds to step S108.

At step S108, test pattern 68 is scanned using reflectance sensor 34 is generate reflectance data, which may be in the form of percent reflectance, as graphically illustrated in graph 66 of FIG. 4.

At step S110, based on the generated reflectance data, an optimal non-nucleating heater pulse for use with ink jet printhead 32 will be determined. The determination may be made, for example, via a calculation, as will be more fully described below. In embodiments of the invention using a continuous single block for test pattern 68, the calculation may be performed by selecting a slope of reflectance data in relation to printhead carrier position. Alternatively, in embodiments of the invention wherein test pattern 68 is formed by a plurality of adjacent blocks, the calculation may be performed by counting blocks which indicates where a transition e.g., slope, of change in reflectance data occurs.

FIGS. 6A-6D combine to form a detailed flowchart depicting a method for determining an optimal non-nucleating pulse in accordance with an embodiment of the present invention. The method will be described with respect to ink jetting apparatus 14 configured with printhead carrier 30 that accommodates mounting multiple, e.g., two, printheads 32, each of which may be integral with an individual replaceable ink jet printhead cartridge 38. The method may be performed, for example, by program instructions executed by controller 22 of ink jetting apparatus 14 and/or by computer 12.

Table 1, below, is a list of a plurality of variables, and their respective definitions, used in algorithms associated with the method of the present invention.

TABLE 1

Variable Definitions

| Variable | Variable Definitions |
|---|---|
| ph | printhead under test (0 = mono, 1 = color, 2 = photo) |
| fp | specific fire pulse increment |
| PREFIRE(ph, fp) | duration of prefire pulse in nano seconds, ns |
| DELAY(ph, fp) | duration of time between end of prefire pulse and beginning of fire pulse in ns |

TABLE 1-continued

| Variable Definitions | |
|---|---|
| Variable | Variable Definitions |
| FIREPULSE(ph, fp) | duration of fire pulse in ns |
| carrier_pos | position of carrier |
| MAX_NUM_FP | maximum number of fire pulses |
| NNO_START | start position for test |
| NNO_dat(fp) | reflectance data |
| m(fp) | slope of the difference in reflectance data, NNO_dat, divided by the difference in the corresponding carrier positions, carrier_pos |
| NNO_THRE | non-nucleation threshold value |

Steps S200 through S218 prepare ink jetting apparatus 14 for generating test pattern 68.

At Step S200, ink jetting apparatus 14 is initialized to perform non-nucleation optimization in accordance with the present invention.

At step S202, a sheet of print media 28, such as plain paper, is loaded into ink jetting apparatus 14.

At step S204, reflectance sensor 34, which may be in the form of an auto-alignment sensor mounted to printhead carrier 30, is calibrated to the plain paper, i.e., the sheet of print media 28. Such calibration techniques are well known in the art.

At step S206, it is determined whether ink jetting apparatus 14 is missing both printheads 32. In other words, it is determined whether the two printhead bays in printhead carrier 30 are empty.

If the determination at step S206 is YES, then at step 208 it is determined not to update the nucleation data, and to set the nucleation data to default. The default is selected to ensure that non-nucleation will be achieved by the pre-fire pulses, and accordingly, lack the benefit of non-nucleation heater pulse optimization. Thereafter, the process ends.

If the determination at step S206 is NO, then at step 210 the default non-nucleation heater pulse width is set for both of printheads 32 installed in printhead carrier 30.

At step S212, a printhead, ph, is selected for the current non-nucleating heater pulse optimization, and the operating temperature is set. As set forth in Table 1, above, a value of ph=0 corresponds to a monochrome printhead, a value of ph=1 corresponds to a color printhead, and a value of ph=2 corresponds to a photo printhead.

At step S214, the position of the carrier, carrier_pos, is set to the start position for the test, NNO_START.

At step S216, the specific fire pulse increment, fp, is set to 0.

At step S218, the duration of prefire pulse, PREFIRE(ph, fp), the duration of time between end of prefire pulse and beginning of fire pulse, DELAY(ph, fp), and the duration of fire pulse, FIREPULSE(ph, fp), are set from a lookup table associated with the printhead under test, ph. The lookup table may be stored, for example, in one of printhead memory 52, memory of computer 12, or memory of ink jetting apparatus 14.

Steps S220 through S226 are performed to generate test pattern 68.

At step S220, the nucleation pattern, i.e., test pattern 68, at FIREPULSE(ph, fp) and at the position of the carrier, carrier_pos(fp), is printed.

At step S222, the value of the specific fire pulse increment, fp, is incremented.

At step S224, it is determined whether the specific fire pulse increment, fp, is less than the maximum number of fire pulses, MAX_NUM_FP, used to generate test pattern 68.

If the determination at step S224 is YES, then at step S226 the position of the carrier, carrier_pos(fp), at the point of printing using FIREPULSE(ph, fp) is stored in memory, such as for example, one of printhead memory 52, memory of computer 12, or memory of ink jetting apparatus 14, and incremented. The sheet of print media 28 is not advanced. Thereafter, the process returns to step S220.

If the determination at step S224 in NO, then the printing of the nucleating pattern, e.g., test pattern 68, is complete.

At steps S228 through S240, the nucleating pattern generated above, e.g., test pattern 68, is read by reflectance sensor 34 to generate reflectance data.

At step S228, the specific fire pulse increment, fp, is set to 0.

At step S230, position of the carrier, carrier_pos, is set to the start position for the test, NNO_START.

At step S232, the position of printhead carrier 30 is advanced to carrier_pos(fp).

At step S234, the reflectance data associated with the current position of the carrier, carrier_pos(fp), is acquired and averaged to form reflectance data NNO_dat(fp).

At step S236, the position of the carrier, carrier_pos(0, 1, . . . ) and reflectance data, NNO_dat(fp), is stored in memory, such as for example, one of printhead memory 52, memory of computer 12, or memory of ink jetting apparatus 14.

At step S238, the value of the specific fire pulse increment, fp, is incremented.

At step S240, it is determined whether the specific fire pulse increment, fp, is less than the maximum number of fire pulses, MAX_NUM_FP.

If the determination at step S240 is NO, then the process returns to step S232.

If the determination at step S240 in YES, then the acquiring of reflectance data from the nucleating pattern, e.g., test pattern 68, is complete.

At step S242, the specific fire pulse increment, fp, is set to 1.

At step S244, the slope, m(fp), of the difference in reflectance data at a corresponding pair of carrier positions is found. The difference in reflectance data may be, for example, the reflectance data corresponding to two adjacent measuring points. The slope may be determined by the formula:

$$m(fp)=(NNO_dat(fp)-NNO_dat(fp-1))/(\text{carrier}_pos(fp)-\text{carrier}_pos(fp-1)).$$

At step S246, the slope m(fp) is stored in memory, such as printhead memory 52, memory of computer 12 or memory of ink jetting apparatus 14.

At step S248, it is determined whether the reflectance data, NNO_dat(fp), is greater than the non-nucleating threshold, NNO_THRE, and whether the slope m(fp), is less than a predetermined threshold constant, e.g., 5.

If the determination at step S248 is NO, then at step S250 it is determined whether specific fire pulse increment, fp, is less than or equal to the maximum number of fire pulses, MAX_NUM_FP.

If the determination at step S250 is YES, then at step S252, the value of the specific fire pulse increment, fp, is incremented, and the process returns to step S244.

If the determination at step S250 is NO, then at step S254 the default non-nucleation value is set in the memory, such as printhead memory 52, as the non-nucleating heater pulse value for the printhead under test, ph.

If, however, the determination at step S248 is YES, then at step S256 the non-nucleation value is stored in the memory, such as printhead memory 54, as the optimal non-nucleating heater pulse value for the printhead under test, ph.

Figure 6A:
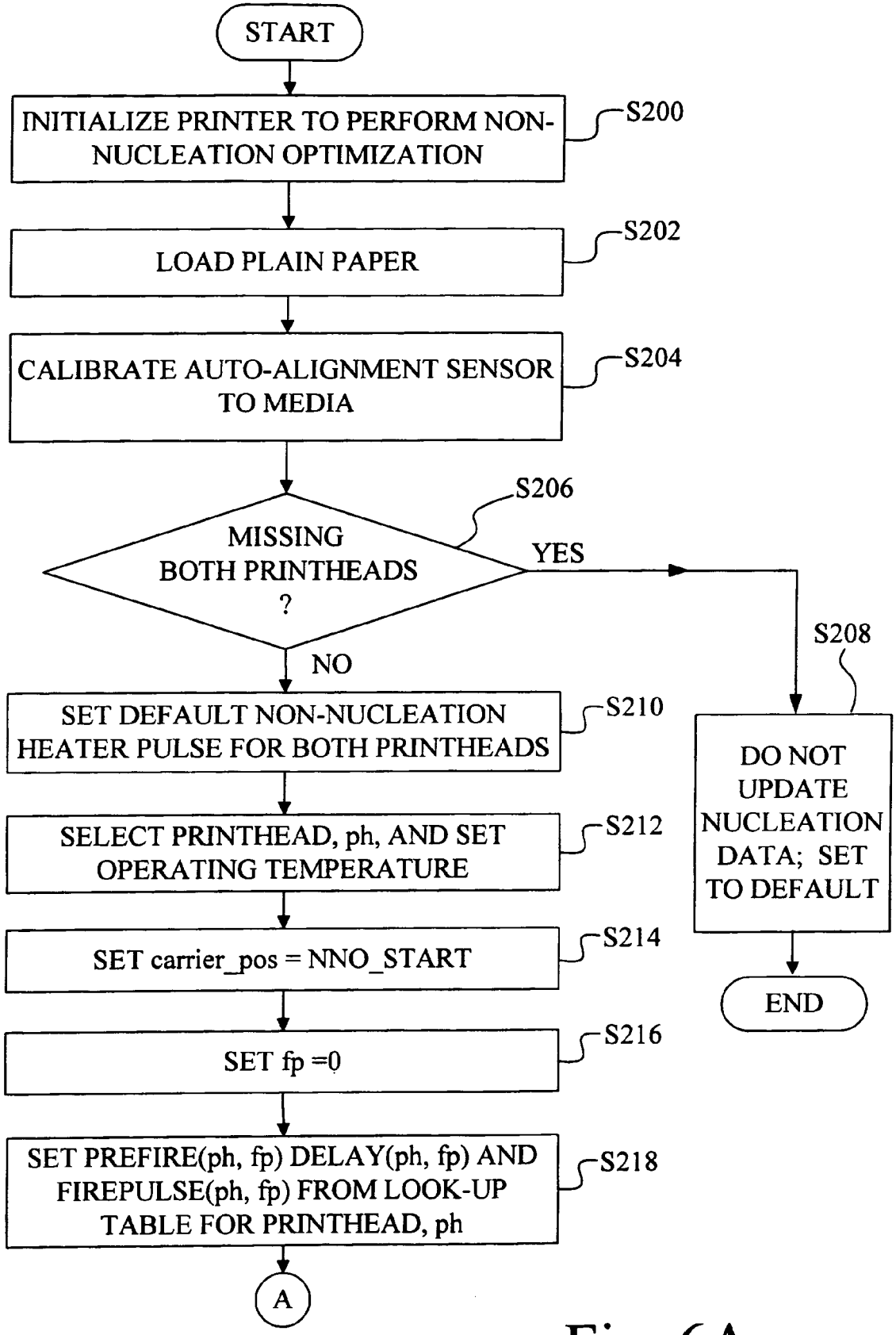
FIGS. 6A-6D combine to form a detailed flowchart of a method for determining an optimal non-nucleating pulse in accordance with an embodiment of the present invention.
Figure 6B:
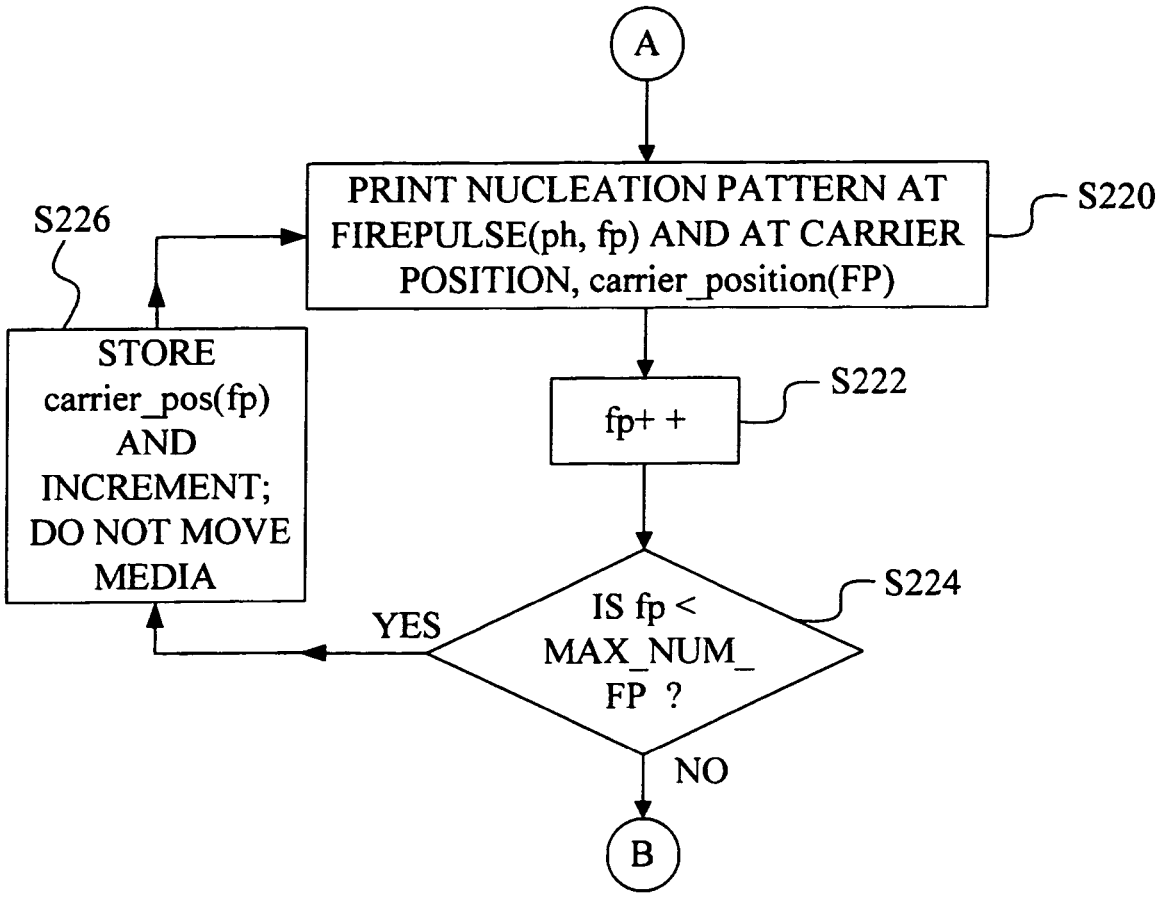
Figure 6C:
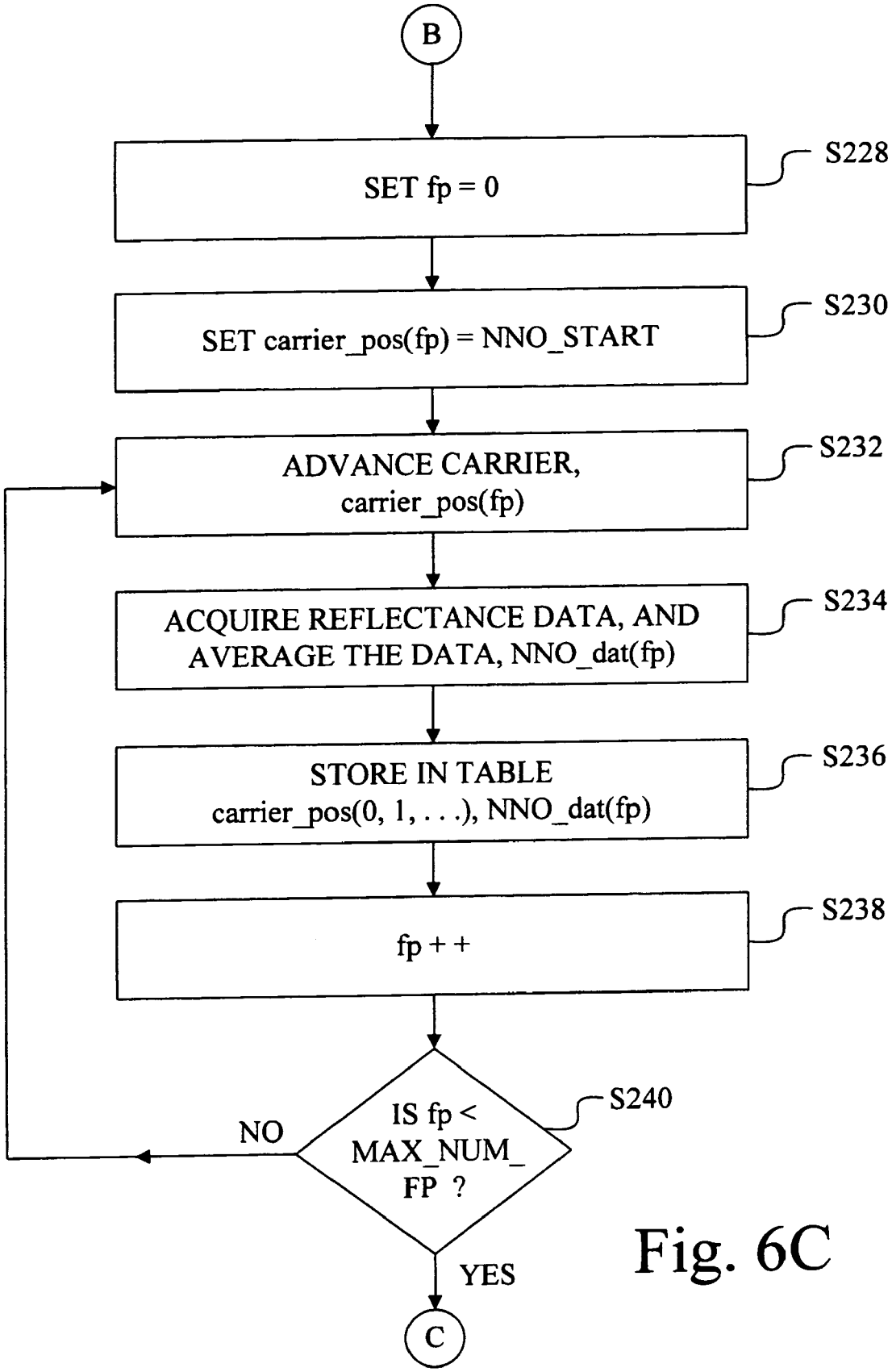
Figure 6D:
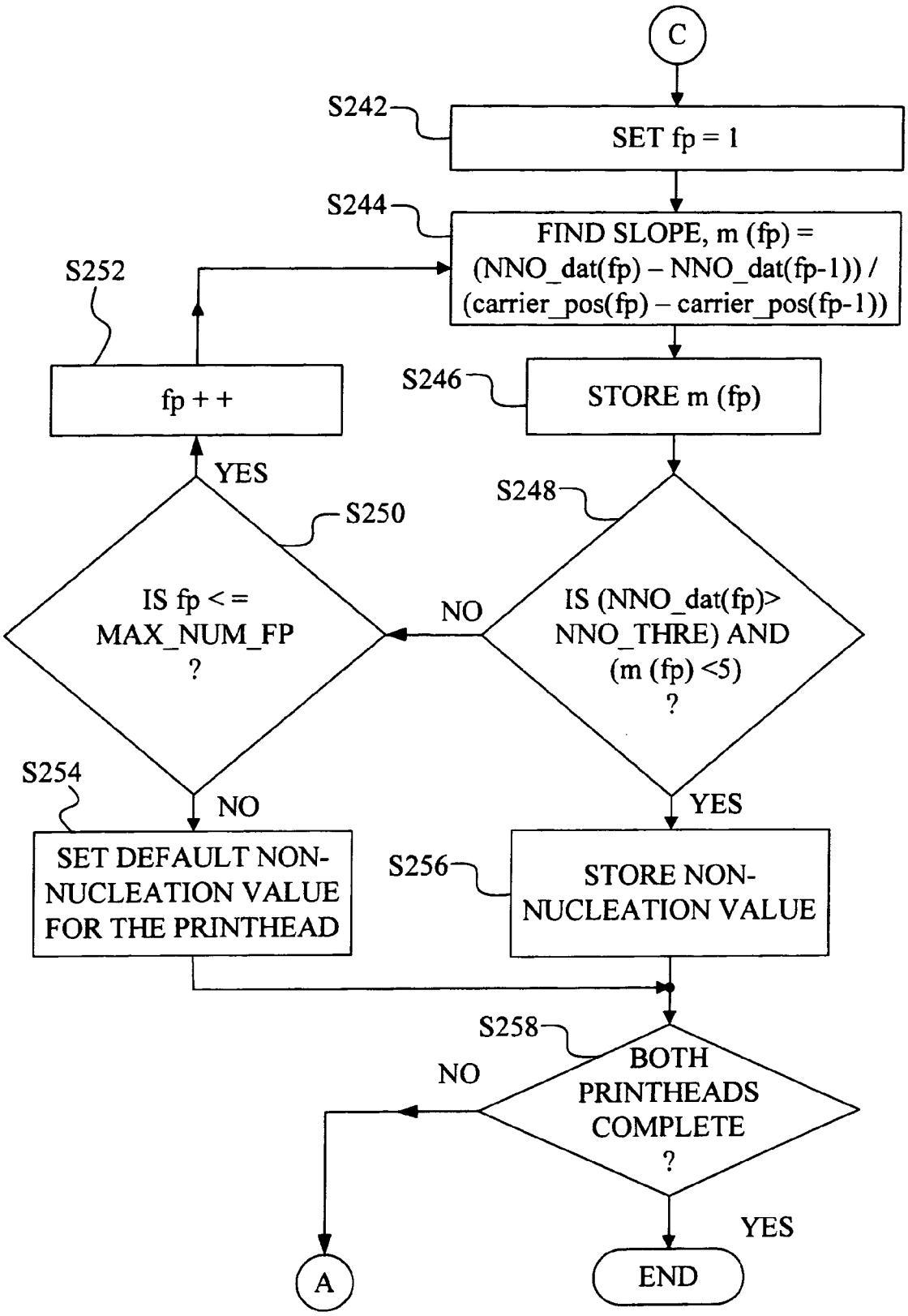

At step S258, it is determined whether the method steps of FIGS. 6B, 6C and 6D have been completed for both printheads 32 installed in printhead carrier 30.

If the determination at step S258 is NO, then the process returns to step S220 to begin determining an optimal non-nucleating heater pulse for use with the other ink jet printhead.

If the determination at step S258 is YES, the process for determining the respective optimal non-nucleating heater pulse for use with each ink jet printhead installed in printhead carrier 30 is complete.

While this invention has been described with respect to exemplary embodiments of the present invention, those skilled in the art will recognize that the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for use with an ink jet printhead having a plurality of nozzles, each of said plurality of nozzles having associated therewith a respective heating element, said method comprising:

printing with said plurality of nozzles a test pattern while varying an energy of a respective heater pulse used to energize each said respective heating element at each of a plurality of printhead carrier positions along a single swath;

scanning said test pattern with a reflectance sensor to generate reflectance data associated with said energy of said respective heater pulse used to energize each said respective heating element at each of said plurality of printhead carrier positions; and determining an optimal non-nucleating heater pulse for use with said ink jet printhead based on said reflectance data, wherein said determining includes:

setting a fire pulse increment variable to a predetermined value;

calculating a slope of a difference in reflectance data at a corresponding difference in a pair of printhead carrier positions of said plurality of printhead carrier positions;

comparing said fire pulse increment variable to a maximum number of fire pulses if said reflectance data is lesser than a non-nucleating threshold and said slope is greater than a predetermined threshold constant; and setting a default non-nucleation value for said ink jet printhead if said fire pulse increment variable is greater than said maximum number of fire pulses.

2. The method of claim 1, wherein said test pattern is generated by scanning said ink jet printhead in a first direction.

3. The method of claim 1, wherein said determining further includes comparing said slope to a threshold value.

4. The method of claim 1, wherein said energy is varied by varying a pulse width of said respective heater pulse.

5. The method of claim 1, wherein said ink jet printhead is integral with a printhead cartridge.

6. The method of claim 1 wherein a value associated with said optimal non-nucleating heater pulse is stored in memory associated with said ink jet printhead.

7. A method for use with an ink jet printhead having a plurality of nozzles each of said plurality of nozzles having associated therewith a respective heating element, said method comprising:

printing with said plurality of nozzles a test pattern while varying an energy of a respective heater pulse used to energize each said respective heating element at each of a plurality of printhead carrier positions;

scanning said test pattern with a reflectance sensor to generate reflectance data associated with said energy of said respective heater pulse used to energize each said respective heating element at each of said plurality of printhead carrier positions; and determining an optimal non-nucleating heater pulse for use with said ink jet printhead based on said reflectance data wherein said determining includes:

setting a fire pulse increment variable to a predetermined value;

calculating a slope of a difference in reflectance data at a corresponding difference in a pair of printhead carrier positions of said plurality of printhead carrier positions and wherein said determining further includes comparing a reflectance value corresponding to a particular carrier position to a first threshold and comparing said slope to a second predetermined threshold, comparing said fire pulse increment variable to a maximum number of fire pulses if said reflectance value is lesser than said first threshold and said slope is greater than said second predetermined threshold; and setting a default non-nucleation value for said ink jet printhead if said fire pulse increment variable is greater than said maximum number of fire pulses and incrementing said fire pulse increment variable if said fire pulse increment variable is less than or equal to said maximum number of fire pulses.

8. A method for use with an ink jet printhead having a plurality of nozzles, each of said plurality of nozzles having associated therewith a respective heating element, said method comprising:

printing with said plurality of nozzles a test pattern while varying an energy of a respective heater pulse used to energize each said respective heating element at each of a plurality of printhead carrier positions;

scanning sad test pattern with reflectance sensor in a single scan to generate reflectance data associated with said energy of said respective heater pulse used to energize each said respective heating element at each of said plurality of printhead carrier positions; and determining an optimal non-nucleating heater pulse for use with said ink jet printhead based on said reflectance data, wherein said determining includes counting blocks, of a plurality of blocks that form said test pattern, which indicates a transition of change in said reflectance data, and wherein said determining includes:

setting a fire pulse increment variable to a predetermined value;

calculating a slope of a difference in reflectance data at a corresponding difference in a pair of printed carrier positions of said plurality of printhead carrier position;

comparing said fire pulse increment variable to a maximum number of fire pulses if said reflectance data lesser than a non-nucleating threshold and said slope is greater than a predetermined threshold constant; and setting a default non-nucleation value for said ink jet printhead if said fire pulse increment variable is greater than said maximum number of fire pulses.

9. An ink jetting apparatus, comprising:

a printhead carrier;

at least one ink jet printhead installed in said printhead carrier, said ink jet printhead having a plurality of nozzles, each of said plurality of nozzles having associated therewith a respective heating element;

a reflectance sensor; and a controller executing program instructions for performing the steps of:

determining whether the at least one ink jet printhead is missing in the ink jetting apparatus and setting a nucleation data to a default value based on said determination;

printing with said plurality of nozzles a test pattern while varying an energy of a respective heater pulse used to energize each said respective heating element at each of a plurality of printhead carrier positions along a single swath;

scanning said test pattern with said reflectance sensor to generate reflectance data associated with said energy of a respective heater pulse used to energize each said respective heating element at each of said plurality of printhead carrier positions; and determining an optimal non-nucleating heater pulse for use with said ink let printhead based on said reflectance data, wherein said determining includes:

setting a fire pulse increment variable to a predetermined value;

calculating a slope of a difference in reflectance data at a corresponding difference in a pair of printhead carrier positions of said plurality of printhead carrier positions;

comparing said fire pulse increment variable to a maximum number of fire pulses if said reflectance data is lesser than a non-nucleating threshold and said slope is greater than a predetermined threshold constant; and setting a default non-nucleation value for said ink jet printhead if said fire pulse increment variable is greater than said maximum number of fire pulses.

10. The ink jetting apparatus of claim 9, wherein said test pattern is generated by scanning said ink jet printhead in a first direction.

11. The ink jetting apparatus of claim 9, wherein said determining the optimal non-nucleating heater pulse includes calculating a slope of a difference in reflectance data at a corresponding difference in a pair of printhead carrier positions of said plurality of printhead carrier positions.

12. The ink jetting apparatus of claim 11, wherein said determining the optimal non-nucleating heater pulse further includes comparing said slope to a threshold value.

13. The ink jetting apparatus of claim 9, wherein said energy is varied by varying a pulse width of said respective heater pulse.

14. The ink jetting apparatus of claim 9, wherein said ink jet printhead is integral with a printhead cartridge.

15. The ink jetting apparatus of claim 9, wherein a value associated with said optimal non-nucleating heater pulse is stored in memory associated with said ink jet printhead.

16. The ink jetting apparatus of claim 9, wherein said reflectance sensor is mounted to said printhead carrier.

17. The ink jetting apparatus of claim 9, wherein said reflectance sensor is a scanner.

18. An ink jetting apparatus, comprising:

a printhead carrier at least one ink jet printhead installed in said printhead carrier, said ink jet printhead having a plurality of nozzles, each of said plurality of nozzles having associated therewith a respective heating element, a reflectance sensor; and a controller executing program instructions for performing the steps of:

printing with said plurality of nozzles a test pattern while varying an energy of a respective heater pulse used to energize each said respective heating element at each of a plurality of printhead carrier positions;

scanning said test pattern with said reflectance sensor to generate reflectance data associated with said energy of a respective heater pulse used to energize each said respective heating element at each of said plurality of printhead carrier positions; and determining an optimal non-nucleating heater pulse for use with said ink jet printhead based on said reflectance data, and wherein said determining further includes:

setting a fire pulses increment variable to a predetermined value;

comparing a reflectance value corresponding to a particular carrier position to a first threshold and comparing said slope to a second predetermined threshold;

comparing said fire pulse increment variable to a maximum number of fire pulses if said reflectance value is lesser than said first threshold and said slope is greater than said second predetermined threshold; and setting a default non-nucleation value for said ink jet printhead if said fire pulse increment variable is greater than said maximum number of fire pulses and incrementing said fire pulse increment variable if said fire pulse increment variable is less than or equal to said maximum number of fire pulses.

19. An ink jetting apparatus comprising:

a printhead carrier;

at least one ink jet printhead installed in said printhead carrier, said ink jet printhead having a plurality of nozzles, each of said plurality of nozzles having associated therewith a respective heating element;

a reflectance sensor; and a controller executing program instructions for performing the steps of:

printing with said plurality of nozzles a test pattern while varying an energy of a respective heater pulse used to energize each said respective heating element at each of a plurality of printhead carrier positions;

scanning said test pattern with said reflectance sensor to generate reflectance data associated with said energy of a respective heater pulse used to energize each said respective heating element at each of said plurality of printhead carrier positions; and determining an optimal non-nucleating heater pulse for use with said ink jet printhead based on said reflectance data, wherein said determining includes counting blocks, of a plurality of blocks that form said test pattern, which indicates a transition of change in said reflectance data, and wherein said determining further includes:

setting a fire pulse increment variable to a predetermined value;

calculating a slope of difference in reflectance data at a corresponding difference in a pair of printed carrier positions of said plurality printhead carrier position;

comparing said fire pulse increment variable to a maximum number of fire pulses if said reflectance data is lesser than a non-nucleating threshold and said slope is greater than a predetermined threshold constant; and setting a default non-nucleation value for said ink jet printhead if said fire pulse increment variable is greater than said maximum number of fire pulses.

* * * * *